US008146312B2

(12) United States Patent
Tucci

(10) Patent No.: US 8,146,312 B2
(45) Date of Patent: Apr. 3, 2012

(54) GARAGE DOOR AND A METHOD OF MAKING A GARAGE DOOR

(76) Inventor: Graziano Tucci, Bolton (CA)

( * ) Notice: Subject to any disclaimer, the term of this patent is extended or adjusted under 35 U.S.C. 154(b) by 0 days.

(21) Appl. No.: 13/082,822

(22) Filed: Apr. 8, 2011

(65) Prior Publication Data

US 2011/0186243 A1 Aug. 4, 2011

Related U.S. Application Data

(63) Continuation of application No. 11/565,778, filed on Dec. 1, 2006, now abandoned.

(51) Int. Cl.
*E06B 3/70* (2006.01)

(52) U.S. Cl. ..... 52/455; 52/309.2

(58) Field of Classification Search ..... 52/455, 52/515, 309.2; 160/35, 214, 236
See application file for complete search history.

(56) References Cited

U.S. PATENT DOCUMENTS

| | | | |
|---|---|---|---|
| 4,132,042 | A | 1/1979 | Di Maio |
| 4,359,845 | A | 11/1982 | Harrison |
| 4,460,030 | A | 7/1984 | Tsunemura et al. |
| 4,538,661 | A | 9/1985 | Henry et al. |
| 4,802,319 | A | 2/1989 | Lafleur |
| 5,060,711 | A | 10/1991 | Fimbell, III |
| 5,435,108 | A | 7/1995 | Overholt et al. |
| 5,445,208 | A | 8/1995 | Shaner et al. |
| 6,119,422 | A | 9/2000 | Clear et al. |
| 7,100,336 | B2 | 9/2006 | Messenger et al. |
| 2004/0006942 | A1 | 1/2004 | Greenway |
| 2004/0168777 | A1 | 9/2004 | Kelley |
| 2004/0206032 | A1 | 10/2004 | Messenger et al. |

OTHER PUBLICATIONS

Prime Stucco & Mouldings, "Technology", http://www.primestucco.com/technology.html, 2004-2006.
Dryvit Systems Inc., Prefabricated Outsulation Panel Systems, 1991.

*Primary Examiner* — Branon Painter
(74) *Attorney, Agent, or Firm* — Bereskin & Parr LLP

(57) ABSTRACT

A garage door or garage door segment is provided, and includes a base structure and a cementitious layer on the exterior face of the base structure.

13 Claims, 9 Drawing Sheets

GARAGE DOOR AND A METHOD OF MAKING A GARAGE DOOR

FIELD OF THE INVENTION

The present invention relates to garage doors.

BACKGROUND OF THE INVENTION

Many different types of garage door exist. Some garage doors are made from solid wood panels. Such doors are typically relatively expensive and offer limited thermal insulation against heat loss to the outside. Other doors are hollow structures, and have relatively thin sheets of wood as their interior and exterior faces, whereby a space exists between the interior and exterior sheets of wood. Some have an insulative material between the interior and exterior sheets of wood. These structures are typically lighter and less expensive than their solid wood counterparts, and may offer relatively greater thermal insulation against heat loss. However, they are also typically easy to dent inadvertently. These structures also typically require regular maintenance. For example, such structures may require regular repainting in order to protect the wood from weather damage.

SUMMARY OF THE INVENTION

In one aspect, the present invention is directed to a garage door that includes a base structure with an exterior face, and a layer of cementitious material on the exterior face of the base structure.

In another aspect, the invention is directed to a method of making a garage door, comprising, providing a base structure with an exterior face, and applying a layer of cementitious material on the exterior face.

In another aspect, the present invention is directed to a garage door segment that includes a base structure with an exterior face, and a layer of cementitious material on the exterior face of the base structure.

BRIEF DESCRIPTION OF THE DRAWINGS

The present invention will now be described by way of example only with reference to the attached drawings, in which.

DETAILED DESCRIPTION OF THE INVENTION

Figure 1:
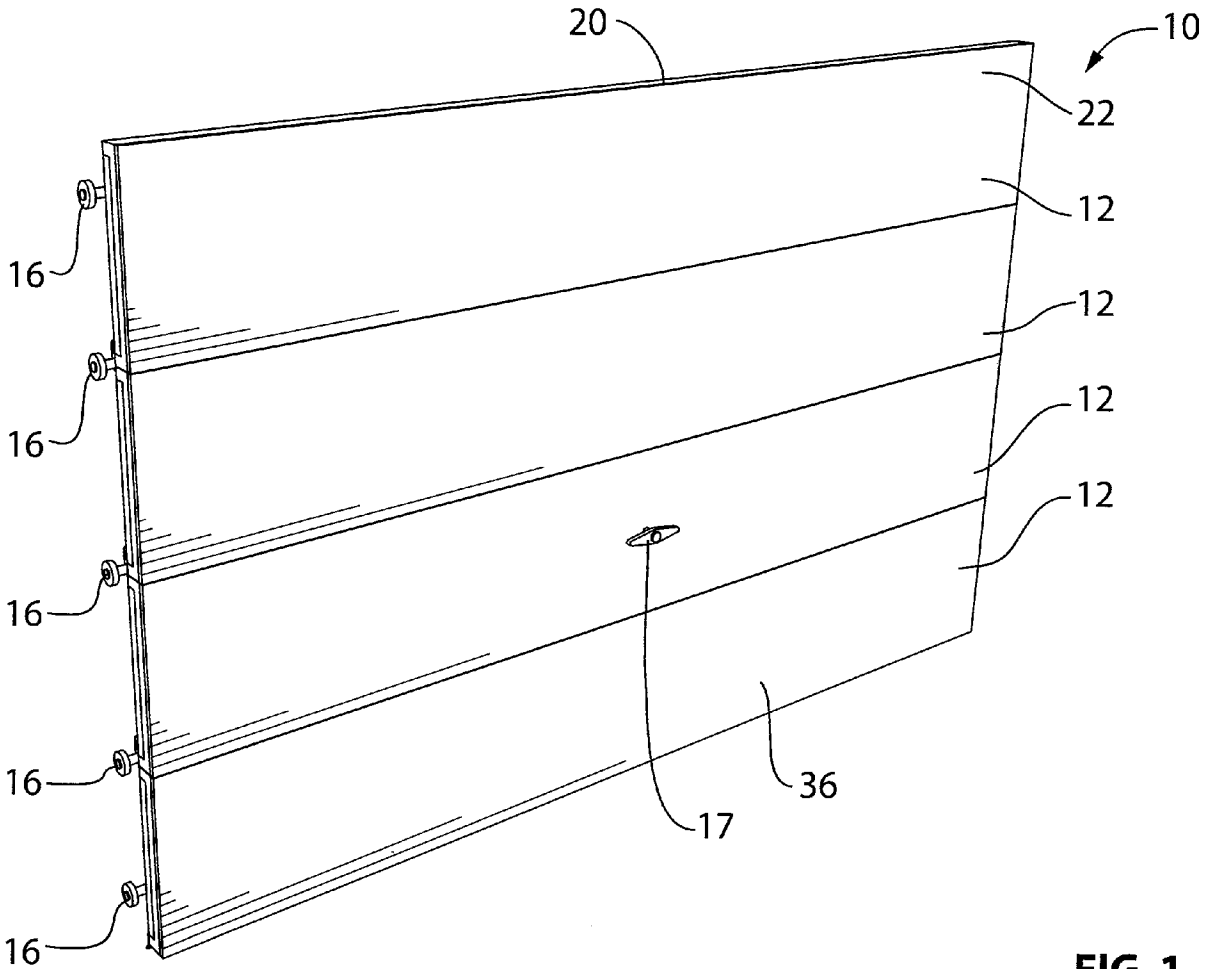
FIG. 1 is a perspective view of a garage door in accordance with an embodiment of the present invention.

Reference is made to FIG. 1, which shows a garage door 10 in accordance with an embodiment of the present invention. The garage door 10 may be made up of a plurality of garage door segments 12, a plurality of door segment connectors 14 (shown more clearly in FIG. 2), which hingedly connect adjacent pairs of garage door segments 12 together and a plurality of door-to-support structure connectors 16 (shown more clearly in FIG. 2), and a handle assembly 17.

Figure 3:
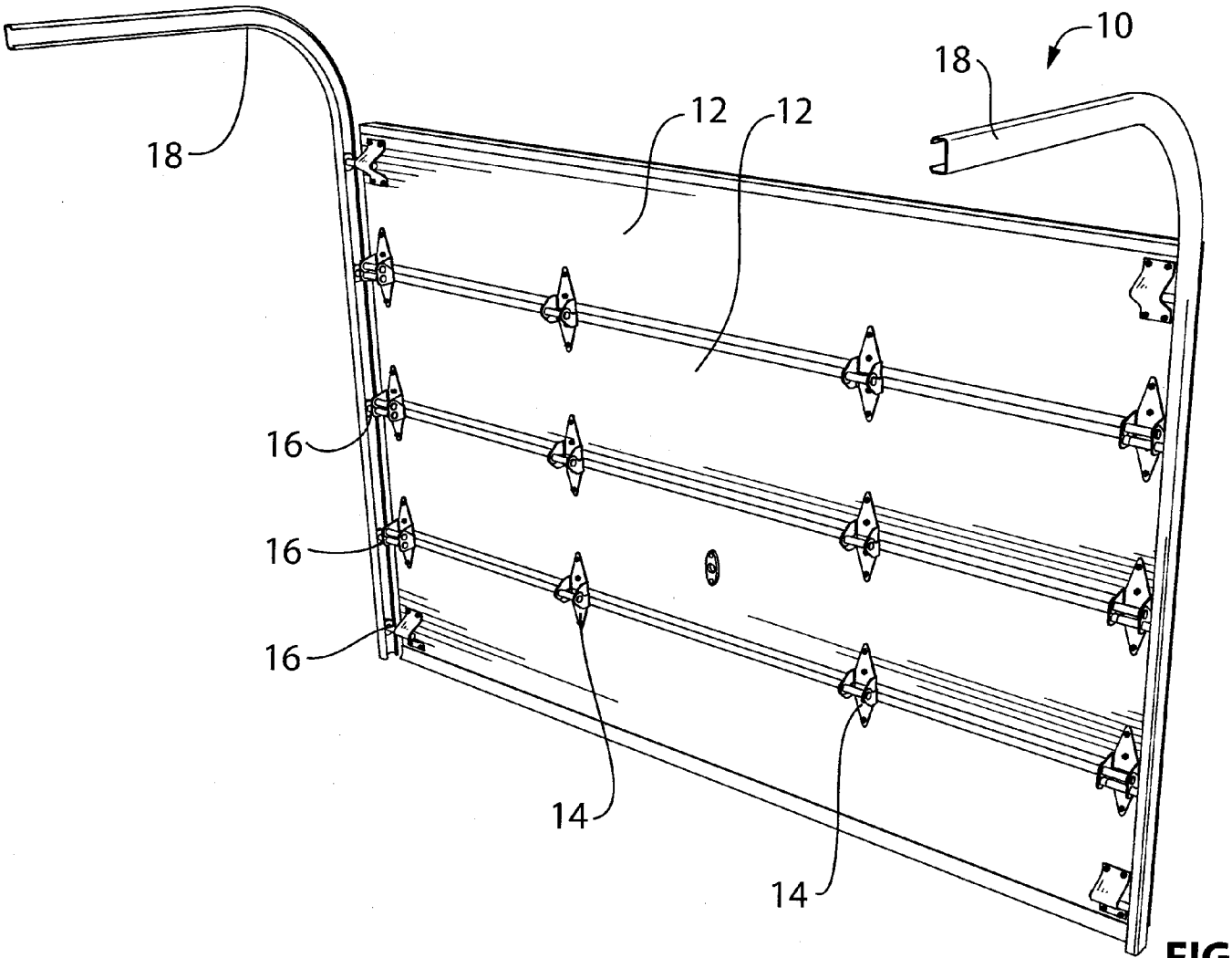
FIG. 3 is a perspective view of the garage door shown in FIG. 1 mounted on a support frame.
Figure 4:
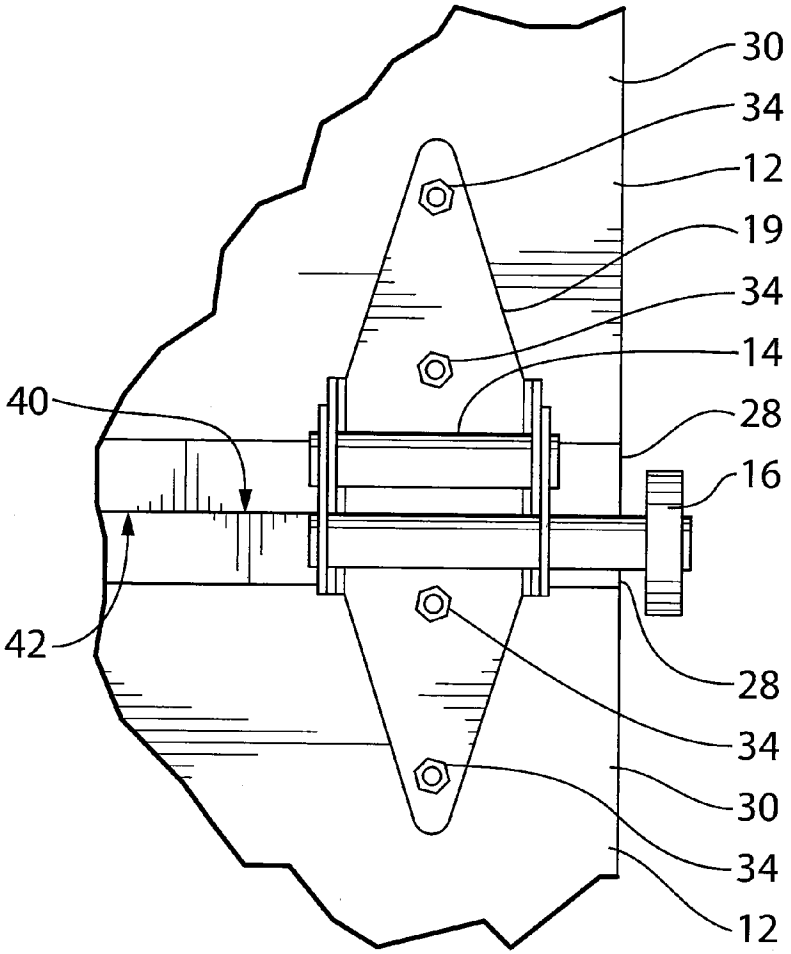
FIG. 4 is a magnified elevation view of a portion of the garage door shown in FIG. 1.

The door-to-support-structure connectors 16 connect the garage door 10 to a garage door support structure 18 in such a way as to permit movement of the door 10 relative to the support structure 18 (see FIG. 3). The door-to-support structure connectors 16 may be, for example, rollers, which roll in a track that is part of the garage door support structure 18 at the entrance to a garage (not shown). As shown in FIG. 4, some of the door segment connectors 14 and some of the door-to-support-structure connectors 16 may be present on a common support member 19.

Figure 5:
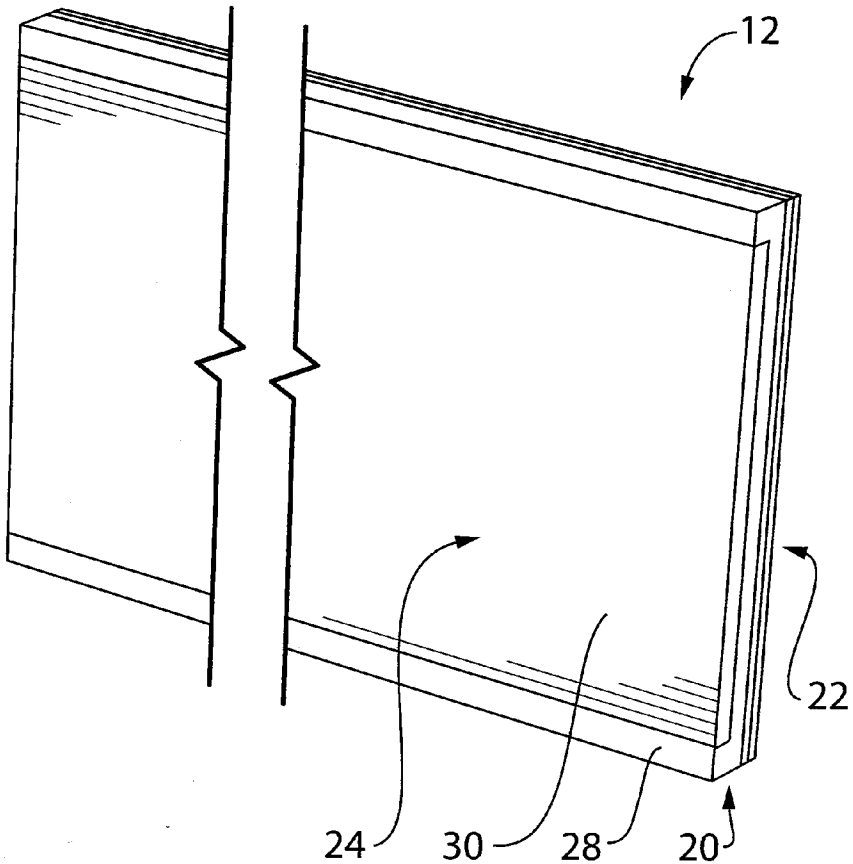
FIG. 5 is a magnified perspective view of one of the garage door segments that are part of the garage door shown in FIG. 1.

Referring to FIG. 5, each garage door segment 12 includes a base structure 20 and a cementitious layer 22. The base structure 20 makes up the body of the garage door segment 12. The base structure 20 has an interior face 24 and an exterior face 26 (shown in FIG. 6).

The base structure 20 may be made from wood. The wood could be solid wood, such as oak. Alternatively it could be some other form of wood, such as plywood. Alternatively, it could be some other material, such as a composite of wood and resin, such as particle board. As another alternative it could be a composite material that includes wood and a polymeric material, such as high density polyethylene (HDPE). It could be made entirely from one or more polymeric materials. The base structure could include one or more aluminum members. The base structure 20 could include cement board. As a further alternative, the base structure 14 could be made from a combination of one or more of the materials described above.

The base structure 20 could be solid, or alternatively it could be a hollow structure comprising an exterior wall and an interior wall. The hollow structure could optionally be provided with an insulative member, such as a Styrofoam™ layer, in the space between the interior and exterior walls.

The base structure 20 is shown magnified in FIG. 5. The base structure 20 includes an insulative member 28 and a strength member 30. The insulative member 28 provides thermal insulation to the garage door segment 12, and may be made from any suitable material, such as a panel of Styrofoam™. To serve an insulating function, the insulative member may be a layer that substantially covers the entire area of the garage door segment 12. The thickness of the insulative member 28 and/or the specific material used may be selected to suit the thermal insulation requirements for the particular installation. The thickness of the insulative member 28 may be, for example, about 1.25 inches or about 2 inches. The insulative member 28 may be provided with a seat 32 for receiving the strength member 30. The seat 32 may have any suitable shape, such as, for example, a channel shape.

The insulative member 28 may alternatively be replaced by a material that is selected to be lightweight, with less regard to its other properties (eg. cost, or R-value). By lightweight, it is meant that it is less dense than the strength member 30. Thus, as its volumetric proportion in the garage door segment 12 increases relative to the volumetric proportion of the strength member 30, the overall weight of the garage door segment 12 decreases. In such a case, the insulative member 28 would instead be referred to as a weight saving member 28.

As another alternative, the insulative member 28 could be replaced by a member selected principally to be a cost saving member, with less regard to its other properties (eg. weight, or R-value).

The strength member 30 provides a mounting for elements such as the segment connectors 14 and the door-to-support-structure connectors 16. An example of this is shown in FIG. 4. The common support 19 for a segment connector 14 and for a door-to-support-structure connector 16 includes a plurality of holes therethrough at each end (eg. three holes) for receiving fasteners 34, which may be, for example, assemblies of a bolt, nut and washer. Providing the strength member 30 through which the bolt can pass increases the strength of the mounting of the common support 19. By contrast, for certain insulative materials, such as Styrofoam™, a bolt may possibly be ripped out of the insulative member 28 during operation of the garage door 10 if no strength member 30 were present.

The strength member 30 may be made from any suitable material, such as wood, a wood composite, a polymeric material, such as high density polyethylene (HDPE), a metal such as aluminum, or any combination thereof.

In an alternative embodiment, the strength member 30 could be replaced by a plurality of smaller strength members positioned at selected positions on the insulative member 28 to provide suitable anchorage for the segment connectors 14 and for the door-to-support-structure connectors 16. By providing a plurality of smaller strength members, the overall weight of the base structure 20 and thus the garage door segment 12 would be lower than that of the garage door segment 12 shown in FIG. 4. The weight savings is advantageous in that it permits less force to be used to lift or close the garage door 10. Thus, if the garage door 10 is opened manually, the user can use less force to perform the operation. If instead the garage door 10 is to be opened using a motor, then the motor could be selected to be smaller than a motor used to lift the garage door 10 if it had a large strength member 28.

A plurality of smaller strength members may also be advantageous by permitting insulative material (eg. Styrofoam™) to occupy a greater volume of the door segment 12, which increases the overall insulative performance of the door segment 12.

Figure 6:
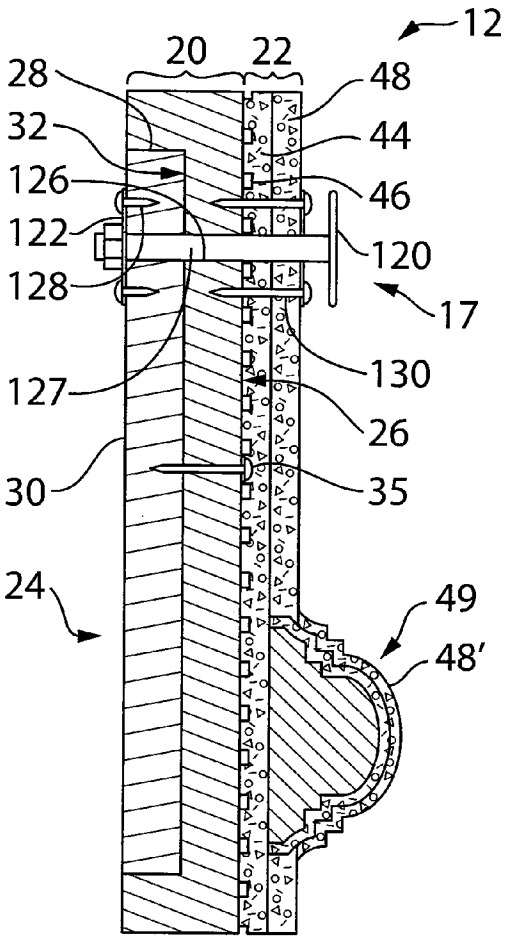
FIG. 6 is a magnified sectional side view of the garage door segment shown in FIG. 5.

Referring to FIG. 6, the strength member 30 may be joined to the insulative member 28 by any suitable means, such as by a plurality of fasteners 35 such as deck screws with washers. The deck screws 35 would be inserted through the insulative member 28 into the strength member. The washers serve to increase the bearing area to transmit forces between the heads of the deck screws and the insulative member 28. Alternatively or additionally, the insulative member 28 may connect with the strength member 30 by means of a suitable adhesive.

Figure 2:
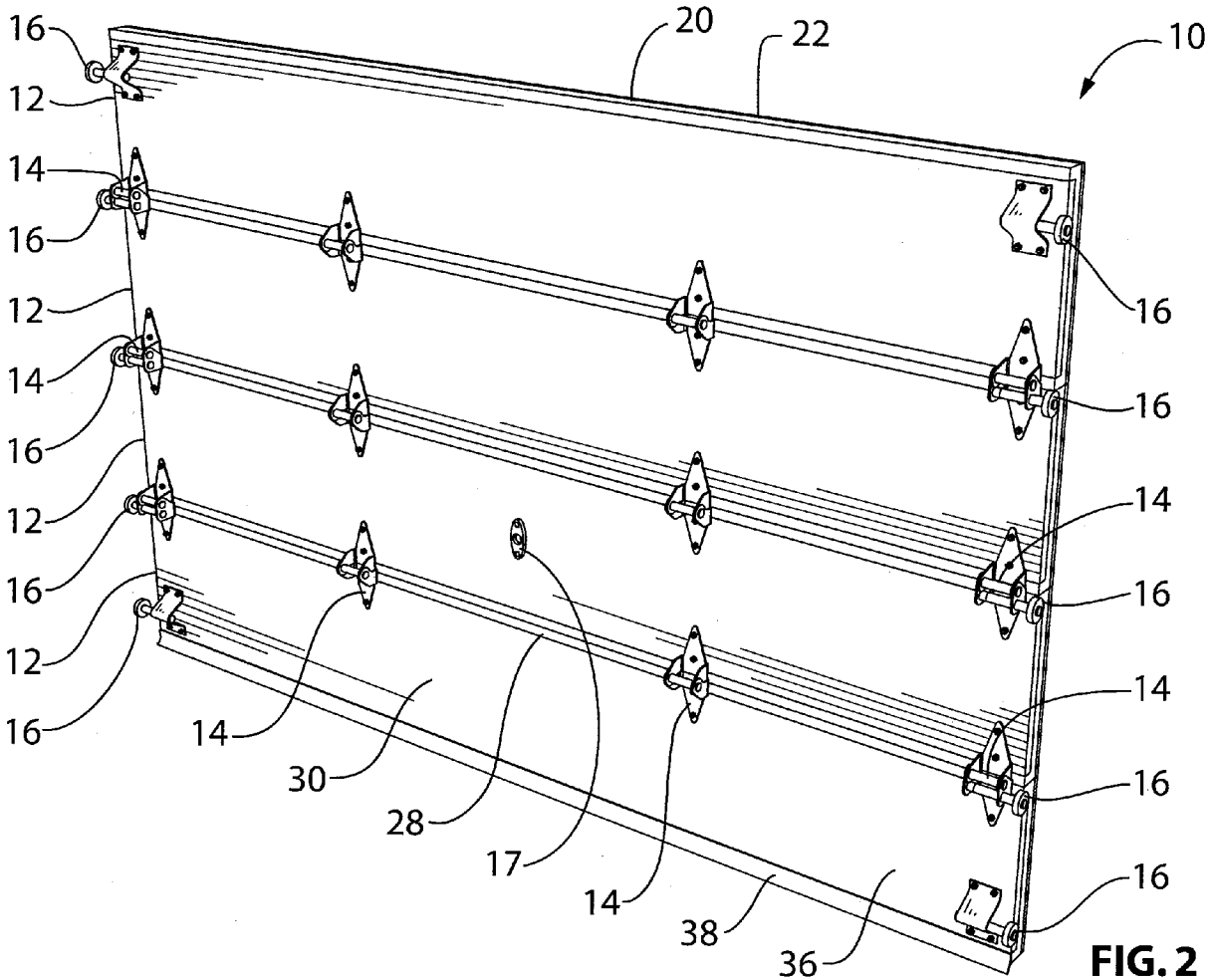
FIG. 2 is another perspective view of the garage door shown in FIG. 1.

For the bottom-most door segment, shown at 36 in FIG. 2, the strength member 30 may extend all the way to the bottom of the door segment 36. This is to provide a mounting for weather stripping, shown at 38, at the bottom of the bottom-most door segment 36.

As best shown in FIG. 6, the strength member 30 may be mounted to be flush with the interior of the insulative member 28. The thickness of the strength member 30 may be any thickness necessary for the installation. For example, the thickness may be about 0.62 inches, or about 0.75 inches.

Referring to FIG. 4, the top and bottom edges of the strength member 30 may be any suitable distance, such as, about 0.75 inches, from the top and bottom edges of the door segment 12, which are shown at 40 and 42 respectively. This permits the use of standard garage door segment hinges while ensuring that the mounting of these hinges occurs through the strength member 30. The strength member 30 could alternatively extend all the way to the top edge and bottom edges 40 and 42 of the door segment 12.

Referring to FIG. 6, the insulative member 28 may be provided with the seat 32 by any suitable means, such as, for example, by machining the shape of the seat 32 from a panel of insulative material. Alternatively, for example, the panel of insulative material may be molded with the shape of seat 32 so that little or no machining is necessary.

The cementitious layer 22 is connected to the exterior face 26 of the base structure 20. The cementitious layer 22 includes a cement base layer 44, a mesh 46 and an exterior cement layer 48.

The cement base layer 44 provides a strong bond to the base structure 20, relative to a hypothetical scenario of simply applying the exterior cement layer 48 directly to the insulative member 28. The cement base layer 44 may be any suitable material, such as Prep Coat D by Durock Alfacing International Limited.

The mesh 46 provides the cementitious layer 22 with increased resistance to fracture during use, from such influences as mechanical stresses (eg. flexing of the garage door segment 12 during use) and weather (eg. temperature fluctuations). The mesh 46 may be made from any suitable material, depending on the material of the exterior face 26 of the base structure 20. For example, the mesh 46 may be made from fiberglass, when used with an insulative layer made from a material such as Styrofoam™.

The cementitious layer 22 may be applied to the exterior face 26 of the base structure 20 in a similar manner to a cementitious layer that would be applied to the exterior faces of insulative panels during home construction. The exterior face of the insulative member 28, which, in the embodiment shown in FIG. 4 is the exterior face 28 of the base structure 20, may be shaved or otherwise machined as necessary to improve its planarity and may be sanded to improve the bond that it will have with the cement base layer 44. The amount of roughening that is carried out depends at least in part on the type of insulative material that is being used in the garage door segment 12.

Any fasteners that pass through the exterior face 26 of the base structure 20 are preferably mounted prior to the application of the cementitious layer 22. Such fasteners may include the fasteners used to mount the segment connectors 14, the door-to-support-structure connector 16 and the weather stripping 38, the fasteners used to mount the handle assembly and the fasteners used to connect the insulative member 28 and the strength member 30 together.

After the exterior face of the insulative member 28 is suitably roughened if necessary and after any fasteners that pass through the exterior surface 26 are mounted, the cement base layer 44 is applied to it. After the cement base layer 44 is applied, the mesh 46 is applied and is pushed into and through the cement base layer 44 into contact with the exterior face of the insulative member 28. The cement base layer 44 is preferably sufficiently thick that the mesh 46 is buried completely in it. After the cement base layer 44 and mesh 46 are applied, the exterior cement layer 48 may be applied to the exterior face of the cement base layer 44.

The exterior cement layer 48 may be made from any suitable material, such as stucco. Stucco is advantageous because it is a material that is easily coloured to suit the tastes of the owner of the building (not shown) on which the garage door 10 (FIG. 1) is to be installed. Additionally, for buildings that have a stucco exterior, the garage door segment 12, and by extension, the garage door 10, can have an external appearance that is substantially identical to that of the exterior of the building, thereby reducing any negative visual impact of having a garage door. As an additional advantage, stucco does not require a coating to protect it from the elements, as it is inherently more resistant to weather damage than some other materials such as wood.

Furthermore, if a building owner wants a garage door to have a specific colour, the typical solution would be to paint the garage door. Generally however, the door will require regular repainting as a result of weather damage or mechanical damage to the paint, which can cause the paint to peel or flake off from the underlying surface. However, with the garage door segment 12, and by extension, with the garage door 10 the colour is engrained in the stucco itself, and is therefore not prone to the above mentioned problems associated with paint.

Referring to FIG. 1, the cementitious layer 22 as a whole provides a dent resistance to the garage door segment and the garage door 10, so that accidental impacts during use are unlikely to penetrate the door segment 12 and thus the door 10, and are unlikely to visually degrade the appearance of the door segment 12 and thus the door 10. By contrast, some garage doors of the prior art have a construction that includes a relatively thin exterior wall of wood with either nothing immediately behind it or with some form of foam insulation behind it. Such garage doors are relatively easy to dent and penetrate, which detracts visually from the appearance of the door.

Another advantage to the garage door segment 12, and by extension, the garage door 10, is that it has the aforementioned dent resistance while having an overall generally lightweight construction. The lightweight-yet-dent-resistant construction is achieved as a result of the combination of having a base structure and a cementitious layer, wherein the base structure is made itself from a combination of a panel of lightweight material, such as Styrofoam™, and one or more strength members, such as the strength members 30, where they are advantageous, such as to receive the mounting fasteners for hinges rollers and the like, and wherein the cementitious layer is applied to the exterior of the base structure to provide dent resistance.

Aside from the above-noted advantages regarding low weight, the cementitious exterior layer 22 is also an inexpensive way of providing dent resistance to a garage door having virtually any construction. Even a garage door with a relatively thick panel of wood on its exterior can be prone to denting as a result of the compressibility of the wood itself. By providing the cementitious exterior layer 22 the dent resistance of the garage door segment or garage door can be increased.

It is possible for the base structure 20 for the garage door segment 12 to be made at the garage door installation site, or alternatively it is possible that the base structure 20 could be made at a production facility and sent to the installation site.

In embodiments wherein the base structure 20 is made at a production facility it is optionally possible for the cementitious layer 22 to be applied in part or in whole to the base structure 20 at the production facility. In such embodiments, the portion of the cementitious layer 22 that is applied at the production facility could include a fiberglass mesh and a cement base layer that is a composition made from polymer and cement. Optionally, the exterior cement layer can be applied at the production facility or at the installation site.

Referring to FIG. 6, the garage door segment 12 may optionally include one or more trim pieces 49 mounted on the exterior. The trim pieces 49 may be provided to enhance the appearance of the garage door segment. The trim pieces 49 may be made from any suitable material. For example, they may include a core made from molded Styrofoam™, and a covering layer of the same material as the cement base layer 44, such as Prep Coat D, or such as a polymer and cement composition. The trim pieces 49 mount to the cement base layer 44. Optionally a construction adhesive may be used to adhere the trim pieces 49 to the cement base layer 44. As another option the trim pieces 49 can be mounted during the application of the cement base layer 44, so that it acts as a construction adhesive itself to hold the trim pieces 49.

The trim pieces 49 may be covered by the same exterior cement layer 48 as the rest of the garage door segment 12. Alternatively, they may be covered in a different exterior cement layer 48'. For example, they may be covered in an exterior cement layer 48' that is a different colour than the exterior cement layer 48 on the rest of the garage door segment 12. Aside from colour, the exterior cement layer 48' may be different from the exterior cement layer 48 in other ways. For example, it may be a roll-on acrylic aggregate paint. Such paint could be used for the rest of the door segment 12 also, however, it is preferable that the exterior cement layer 48 be relatively thick (eg. 0.062 inch) to provide a relatively greater resistance to fracture.

If at some point during use it is desired to change the colour of the garage door segment 12, it is possible to cover the previous exterior-most layer with a new layer. The new layer may be, for example, an acrylic aggregate paint similar to that which was described for covering the trim pieces 49. Alternatively, the new layer may be, a layer of stucco, similar to that which was described above for covering the cement base layer 44 on the planar portion of the garage door segment 12.

In an alternative embodiment, the garage door segment 12 may be molded or formed with the molded shape provided by the trim pieces 49 instead of having separate trim pieces mounted to a planar panel.

As a related optional feature, the panel of insulative material may have other features molded or otherwise formed therein. For example, the address of the building or some other alphabetic and/or numeric characters may be provided in the insulative member 28.

The handle assembly 17 is shown in FIG. 6. The handle assembly 17 may be mounted after the application of the cementitious layer 22. The handle assembly includes a handle 120, an interior plate 122 and an exterior plate 124. An aperture 126 is provided through the entirety of the door segment 12 for the pass through of the stem of the door handle 17, shown at 127. The interior plate 122 covers the aperture 126 and supports the interior end of the stem 127 of the handle 120. The interior plate 122 is mounted to the strength member 30 by means of fasteners 128. The exterior plate 124 covers the aperture 126 and supports the exterior end of the stem 127 of the handle 17. The exterior plate 124 is mounted on or partially in the cementitious layer 22 and is connected to the strength member 30 by means of fasteners 130.

Figure 7A:
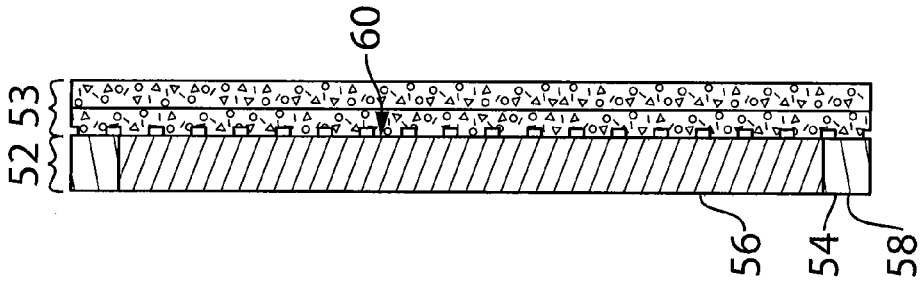
FIG. 7*a* is a magnified sectional side view of the garage door segment shown in FIG. 7.
Figure 7:
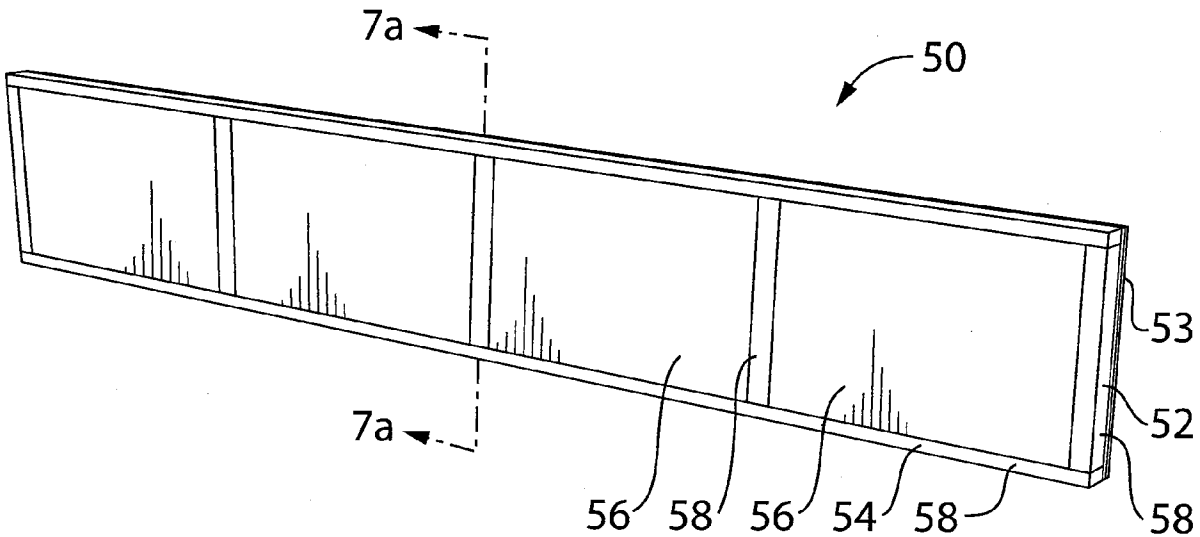
FIG. 7 is a magnified perspective view of an alternative garage door segment that could be used as part of a garage door in accordance with another embodiment of the invention.

A garage door segment 50 in accordance with an alternative embodiment of the present invention is shown in FIG. 7. The garage door 50 includes a base structure 52 and a cementitious layer 53. The base structure 52 includes a frame 54 and one or more weight saving and/or insulative and/or cost-saving panels 56. The frame 54 may be made from a suitably strong material, such as any of the materials used for the strength member 30 in the base structure 20 shown in FIG. 5. The members of the frame 54 are shown at 58, and are positioned to provide strength to the garage door segment 50. The frame members 58 have suitable dimensions so that they can receive the mounting fasteners for the segment connectors 14 and the door-to-support-structure connectors 16. The one or more panels 56 fit in the frame 54, and are preferably positioned such that their exterior surfaces are flush with the exterior face of the frame 54 to form a smooth exterior face 60 (see FIG. 7*a*). The one or more panels 56 may be joined to the frame 54 by any suitable means, such as by a suitable adhesive.

The cementitious layer 53 may be applied to the exterior face 60 of the base structure 52. The cementitious layer 53 may have any suitable make up and configuration. For example, the cementitious layer 53 may be similar to the cementitious layer 22 in the embodiment shown in FIG. 5.

Figure 8:
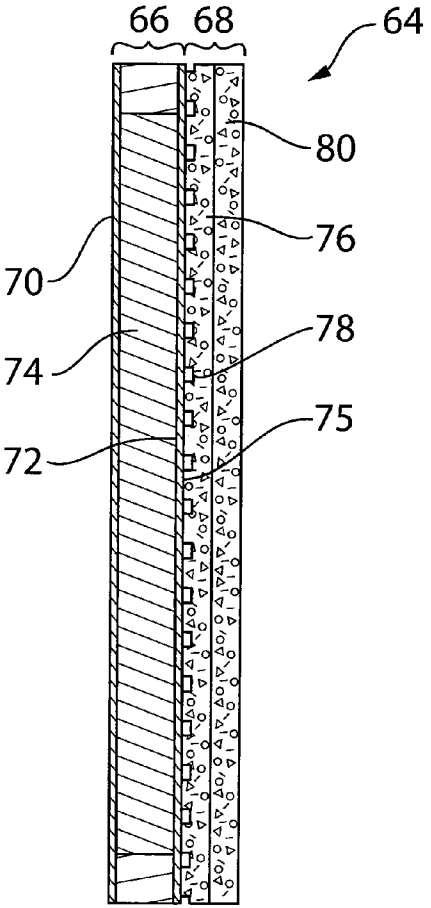
FIG. 8 is a magnified sectional side view of an alternative garage door segment that could be used as part of a garage door in accordance with yet another embodiment of the invention.

Another alternative construction for a garage door segment is shown at 64 in cross-section in FIG. 8. The garage door segment 64 includes a base structure 66 and a cementitious layer 68. The base structure 66 includes an interior wall 70, an exterior wall 72 that is spaced from the interior wall 70 by a gap, an optional insulative member 74 positioned in the gap between the interior and exterior walls 70 and 72 (wherein the insulative member 74 may partially or alternatively substantially fill the gap).

The interior and exterior walls 70 and 72 may be made from any suitable material, such as plywood. The material of the insulative member 74 may be lightweight relative to the one or more materials that make up the interior and exterior walls 70 and 72. The material of the insulative member 74 may be any suitable material such as sprayed foam insulation, or panels of insulative material such as Styrofoam™.

The exterior face of the base structure 66 is shown at 75. The cementitious layer 68 is connected to the exterior face 75. The cementitious layer 68 includes a cement base layer 76, a mesh 78 and an exterior cement layer 80. Depending on the material of the exterior wall 72, the mesh 78 may be stapled or nailed to the wall 72. The mesh 78 in such a case is preferably made from a metal, such as galvanized steel.

The cement base layer 76 may be applied to the exterior face 75 after the mesh has been secured. The cement base layer 76 is preferably applied in sufficient thickness so as to bury the mesh 78 so that the exterior face of the cement base layer 76 is smooth.

The material of the cement base layer 76 may be any suitable material, such as Prep Coat D by Durock Alfacing International Limited.

Figure 9:
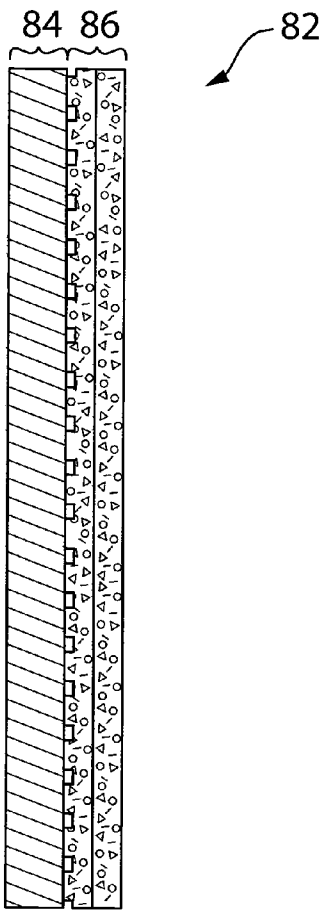
FIG. 9 is a magnified sectional side view of an alternative garage door segment that could be used as part of a garage door in accordance with yet another embodiment of the invention.

Reference is made to FIG. 9, which shows a garage door segment 82 which is solid, and does not include insulative material such as Styrofoam™. The garage door segment 82 includes a base structure 84 and a cementitious layer 86. The base structure 84 may be a panel of a single material, such as oak. Alternatively, the garage door segment 82 may be made from a plurality of layers of material. For example, it may be made with a core of a first material, such as plywood, and a sheet of wood veneer on either or both of the interior and exterior faces of the core.

The cementitious layer 86 may be similar to the cementitious layer 68 described above with respect to FIG. 8. It will be understood that the cementitious layer 86 may provide some level of increased dent resistance to the garage door segment 82 even though the base structure 84 may be solid. Some types of wood are potentially crushable depending on the type of impact they receive, and depending on such things as the density of the wood. Thus the addition of the cementitious layer 86 can increase the dent resistance of the garage door 12.

Figure 10:
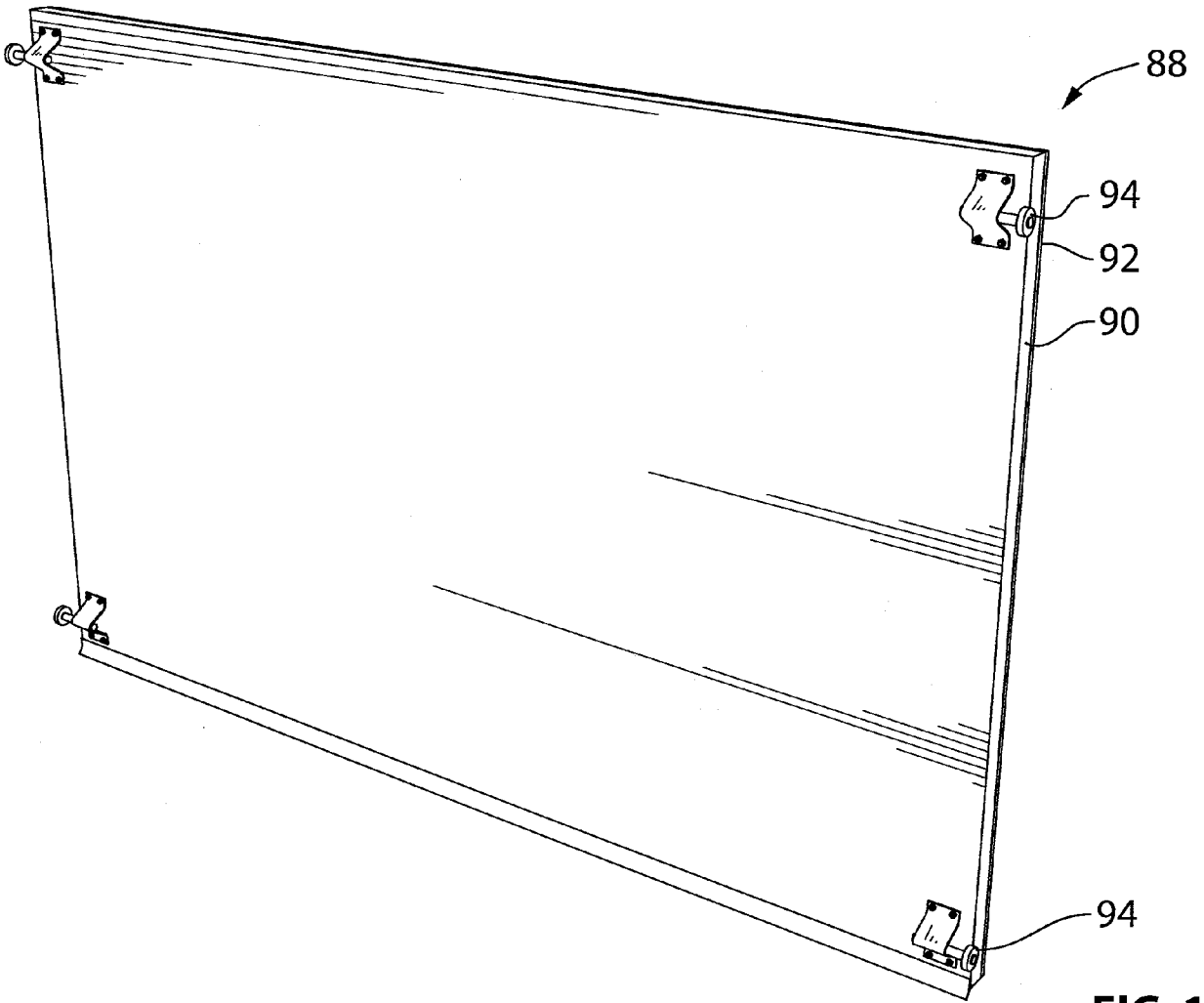
FIG. 10 is a perspective view of an alternative garage door that could be used as part of a garage door in accordance with another embodiment of the invention.

Reference is made to FIG. 10, which shows a garage door 88 that is a single large panel, instead of being made from a plurality of segments hingedly joined together. The garage door 88 includes a base structure 90 and a cementitious layer 92. The construction of the base structure 90 and cementitious layer 92 may be similar to the construction of any of the base structures and cementitious layers described above. FIG. 10 illustrates that a garage door construction in accordance with the present invention may be provided in a single panel configuration.

Exemplary door-to-support-structure connectors for the garage door 88 are shown at 94, however any suitable door-to-support-structure connectors could be used for the purpose of mounting the door 88 to a garage door mounting frame.

Figure 11A:
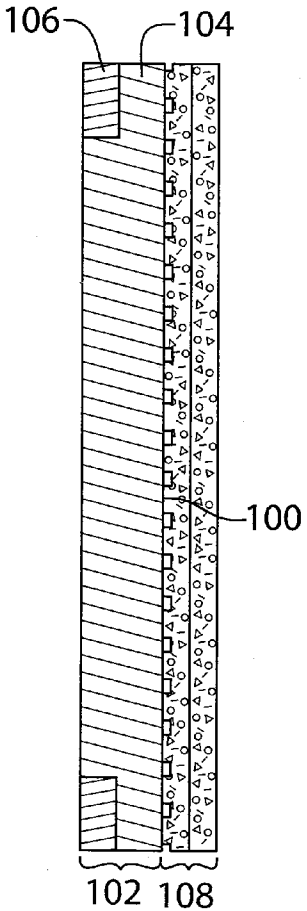
FIG. 11*a* is a magnified sectional side view through section line 11*a*-11*a* of the garage door segment shown in FIG. 11.
Figure 11:
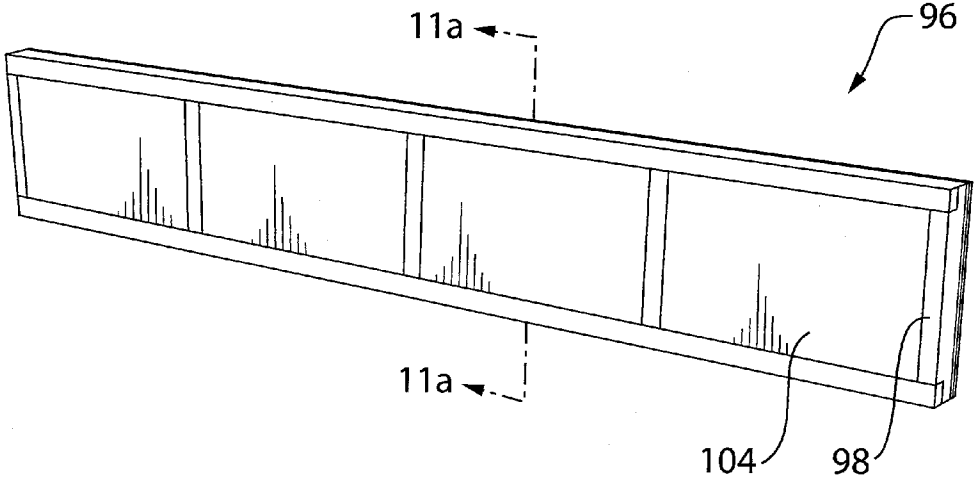
FIG. 11 is a perspective view of an alternative garage door that could be used as part of a garage door in accordance with another embodiment of the invention.

Reference is made to FIG. 11, which shows a garage door 96 in accordance with an alternative embodiment of the present invention. The garage door segment 96 may be similar to the garage door segment 50 shown in FIG. 7, except that the frame shown 98 in FIG. 11 does not extend all the way to the exterior face 100 (see FIG. 11*a*) of the base structure 102.

As best shown in FIG. 11*a*, the insulative member, shown at 104 has a seat 106 thereon for the frame 98. Among other things, this configuration for the base structure 102 may be lighter than the base structure 52 shown in FIG. 7*a* because of the reduced thickness of the frame 98.

The cementitious layer that is included in the garage door segment 96 is shown at 108 in FIG. 11*a* and may be similar to the cementitious layer 53 shown in FIG. 7*a*.

In the embodiment shown in FIGS. 11 and 11*a*, the interior face of the insulative member 104 is flush with the interior face of the frame 98. It is alternatively possible for the insulative member to not have a seat 106, so that the frame 98 mounts to the interior face of the insulative member and is not flush therewith.

In an embodiment of the present invention, it is contemplated that a cementitious layer as described and shown herein may be applied to a pre-existing garage door. The pre-existing garage door would effectively become a base structure, and the cementitious layer would be selected based on the material on the exterior face of the base structure.

In some regions, garage doors may come in one of two standard thicknesses, which are 125 inches and 2 inches. While the cementitious layer that is applied to the pre-existing garage door may be relatively thin, (eg. approximately ⅛ inch), it may be necessary for any rollers that connect the garage door to a garage door track to be positionally adjusted or replaced.

In an alternative embodiment not shown in the figures, the base structure of the garage door segment or garage door could be made from a layer of cement board, screwed or otherwise fastened to the exterior of a wood panel. A cementitious layer similar to that which can be used to connect to Styrofoam™ can be connected to the cement board.

It is contemplated that windows may be incorporated into at least some of the above-described embodiments. The windows may be incorporated in any suitable way. For example, for the embodiment shown in FIG. 5, window apertures may be provided in the garage door segment 12 that is selected to have windows. Surrounding the window apertures, a seat may be provided in the light weight member 28, into which a pane of transparent or translucent material, such as clear or frosted glass, or clear or frosted Plexiglas™ may be inserted. The seat may be made sufficiently deep so that the interior surface of the pane is flush with the surrounding interior surface of the lightweight member 28. The strength member 30 may then be laid in its seat in the light weight panel 28, and would pin the pane in plane in its seat. A suitable window aperture can be provided in the strength member 30 to permit light to pass through the pane. On the exterior of the segment 12, the cementitious layer would be applied up to the pane in similar fashion to a cementitious layer on a house or other building up to any delimiter.

In at least some of the embodiments described above, it is possible to incorporate a vapour barrier material in the base structure to inhibit moisture from passing into the garage door segment. The vapour barrier may be positioned in any suitable position in accordance with the practices in use today in housing or building construction.

It is contemplated that any of the garage doors or garage door segments described above could be sold and shipped to an installation company or person (ie. a company or person that will ultimately install the garage door on the frame 18), without any door segment connectors 14 or any door-to-support-structure connectors 16. These components could be provided some other way, such as, for example, by the installation company or person.

In the embodiments above that describe garage door segments which are to be connected together to make a garage door, a base structure for the garage door is defined as being made up of the group of base structures of the garage door segments. The garage door includes a cementitious layer on the exterior face of the base structure, which is made up of the cementitious layers on each of the door segments.

While the above description constitutes a plurality of embodiments of the present invention, it will be appreciated that the present invention is susceptible to further modification and change without departing from the fair meaning of the accompanying claims.

The invention claimed is:

1. A garage door segment for use in a garage door comprising a plurality of such segments and an opening and closing mechanism, said door being movable between an open substantially horizontal position and a closed substantially vertical position in which the door closes an opening to a garage, the garage opening having a width, the garage door segment comprising:

a panel member having a length, the panel member comprising a lightweight insulative substrate, the substrate having an exterior face and an interior face, the interior face having an upper protruding portion and a lower protruding portion, at least one recessed seat portion being formed in the substrate between the two protruding portions and extending substantially the length of the panel member;

at least one reinforcing member fixed in and substantially filling the at least one seat to provide additional rigidity to the panel member, the reinforcing member extending substantially the length of the seat, wherein the interior surfaces of the protruding portions and the interior surface of the reinforcing member are substantially flush;

a mesh for relieving bending stresses on the panel member;

a cementitious layer on the exterior face of the panel member, wherein the mesh is located within the cementitious layer; and a plurality of connectors attached to the reinforcing member and configured for movably connecting the garage door segment to the garage door opening and closing mechanism.

2. A garage door segment as claimed in claim 1, wherein the insulative substrate is made from expanded polystyrene.

3. The garage door segment of claim 1, further comprising:

two seats extending substantially the length of the panel member;

two reinforcing members; each reinforcing member fixed in one of the seats to provide additional rigidity to the panel member, each reinforcing member extending substantially the length of the seat.

4. The garage door segment of claim 1, wherein the reinforcing member is made of metal.

5. The garage door segment of claim 4, wherein the reinforcing member is made of aluminum.

6. The garage door segment of claim 1, wherein the reinforcing member is made of wood.

7. The garage door segment as claimed in claim 1, wherein the cementitious layer includes a layer of stucco.

8. The garage door segment as claimed in claim 1, wherein the cementitious layer comprises a cement base layer and a layer of stucco wherein the mesh and cement base material are immediately adjacent to the panel member, and wherein the stucco is immediately adjacent the cement base layer.

9. The garage door segment of claim 1, wherein the cementitious layer is not more than about ⅛" thick.

10. The garage door of claim 1, wherein the cementitious layer is less than about 0.062" thick.

11. A garage door system, comprising:

a garage door opening and closing mechanism; and a garage door, comprising:

a panel member having a length, the panel member comprising a polystyrene substrate, the substrate having an exterior face and an interior face, the interior face having an upper protruding portion and a lower protruding portion, at least one recessed seat portion being formed in the substrate between the two protruding portions and and extending substantially the length of the panel member;

at least one reinforcing member fixed in and substantially filling the at least one seat to provide additional rigidity to the panel member, the reinforcing member extending substantially the length of the seat, wherein the interior surfaces of the protruding portions and the interior surface of the reinforcing member are substantially flush;

a mesh for relieving bending stresses on the panel member;

a cementitious layer on the exterior face of the panel member, wherein the mesh is located within the cementitious layer; and a plurality of connectors attached to the reinforcing member and configured for movably connecting the garage door to a garage door opening and closing mechanism.

12. The garage door of claim 11, wherein the cementitious layer is not more than about ⅛" thick.

13. The garage door of claim 11, wherein the cementitious layer is less than about 0.062" thick.

* * * * *